US005096203A

United States Patent [19]

Elstein et al.

[11] Patent Number: 5,096,203

[45] Date of Patent: Mar. 17, 1992

[54] TRI STATE THUMB WHEEL

[76] Inventors: Moshe Elstein, 25/b Stern St,, Kiron, Israel, 55602; George Spector, 233 Broadway RM 3815, New York, N.Y. 10007

[21] Appl. No.: 648,637

[22] Filed: Jan. 31, 1991

[51] Int. Cl.[5] ..... A63F 3/00

[52] U.S. Cl. ..... 273/239; 273/281; 273/284; 273/143 C

[58] Field of Search ..... 273/281, 284, 239, 282, 273/1 M, 193 C, 142 JB

[56] References Cited

U.S. PATENT DOCUMENTS 2,039,969 5/1936 McIntoch ..... 273/143 C
3,797,829 3/1974 Heller ..... 273/281
4,783,081 11/1988 Eckhardt ..... 273/281
4,890,845 1/1990 Gatewood ..... 273/281

FOREIGN PATENT DOCUMENTS 374474 4/1923 Fed. Rep. of Germany ..... 273/281
0051234 4/1977 Japan ..... 273/281

*Primary Examiner*—Benjamin Layno

[57] ABSTRACT

A board game apparatus is provided and consists of a plurality of changeable playing indicating pieces that are each built into a top surface of a playing board housing being a playing field zone so that one portion of each playing indicating piece will always extend above the top surface to be utilized during the play of the game.

4 Claims, 1 Drawing Sheet

TRI STATE THUMB WHEEL

BACKGROUND OF THE INVENTION

The instant invention relates generally to game devices and more specifically it relates to a board game apparatus which provides a plurality of rotatable indicator drums within a playing board which replace playing pieces being of two different color types.

There are available various conventional game devices which don not provide the novel improvements of the invention herein disclosed.

SUMMARY OF THE INVENTION

A primary object of the present invention is to provide a board game apparatus that will overcome the shortcomings of the prior art devices.

Another object is to provide a board game apparatus that includes a plurality of rotatable indicator drums within a playing board which substitute for playing pieces of two different color types that are utilized in playing the game.

An additional object is to provide a broad game apparatus that includes a register member for each rotatable indicator drum so that when playing checkers the indicator drum can become kinged during the play of the game.

A further object is to provide a board game apparatus that is simple and easy to use.

A still further object is to provide a board game apparatus that is economical is cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
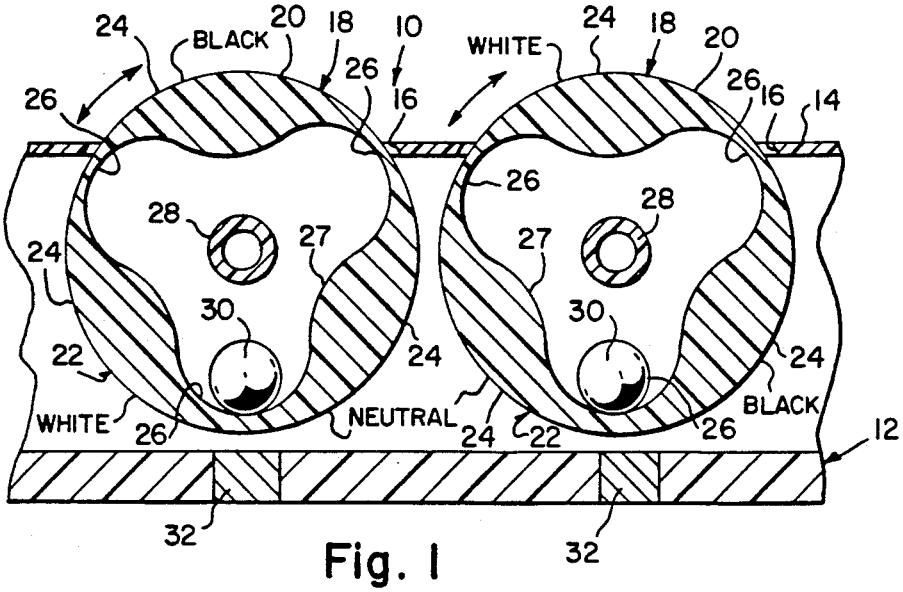
FIG. 1 is a cross sectional view of a portion of a playing board showing he instant invention therein.

Turning now descriptively to the drawings, in which similar reference characters denote similar elements throughout the several views. the figures illustrate a board game apparatus 10 consisting of a playing board housing 12 having a top surface 14 with a plurality of different playing field zones 16 disposed therein. A plurality of changeable playing indicating pieces 18 are provided with each built into the playing board housing 12 within each of the playing field zones 16. One portion 20 of each playing indicating piece 18 will always extend above the top surface 14 of the playing board housing 12 to be utilized during the play of the game.

Each playing indicating piece 18 includes a hollow indicator drum 22 having a plurality of indicia bearing faces 24 such as colors black, white and neutral extending about its circumference and a plurality of depressions 26 extending about its interior surface 27 with each depression 26 being opposite from each indicia bearing face 24. A shaft 28 is for rotatably supporting the indicator drum 22 within the playing board housing 12 at the playing field zone 16 on the top surface 14 thereof. A ferromagnetic ball 30 rides within the interior surface 27 of the indicator drum 22. A permanent magent 32 is carried in the playing board housing 12 below the indicator drum 22 to attract the ferromagnetic ball 30 thereto and stop the indicator drum 22 from rotating.

Figure 2:
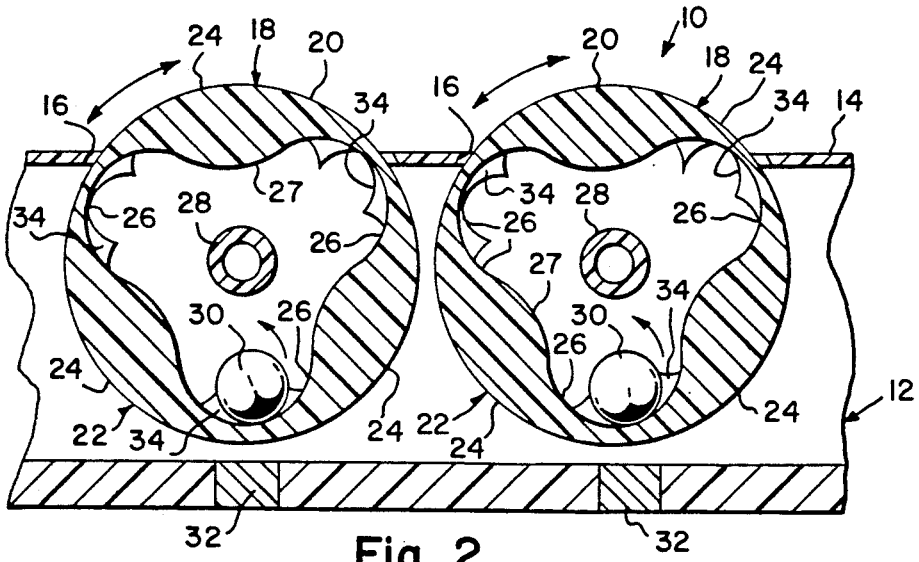
FIG. 2 is a cross sectional view similar to FIG. 1 showing three cam systems within the interior surface of each indicator drum to help lift the ball so that the indicator drum can be easily manually rotated in either direction to change the indicia on the exposed exterior periphery.

Each indicator drum 22 can further include, as shown in FIG. 2, a plurality of cam systems 34, each located within each depression 26 to help lift the ball 30 so that the indicator drum 22 can be easily manually rotated in either direction to change the indicia 24 on the exposed circumference above the top surface 14 of the playing board housing 12.

Figure 3:
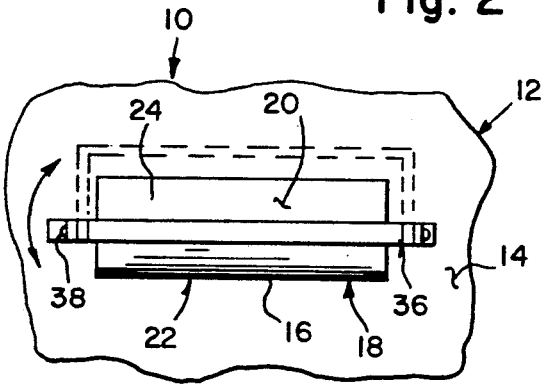
FIG. 3 is a top view of a portion of the playing board showing a register member that can be raised over the indicator drum to show it as a simulated kinged playing piece when playing checkers.

As shown in FIG. 3, a register member 36 can be pivotly mounted at 38 on the top surface 14 of the playing board housing 12 at the playing field zone 16. The register member 36 can be raised over the indicator drum 22 to show it as a simulated kinged playing piece when the apparatus 10 is being used for playing checkers.

Figure 4:
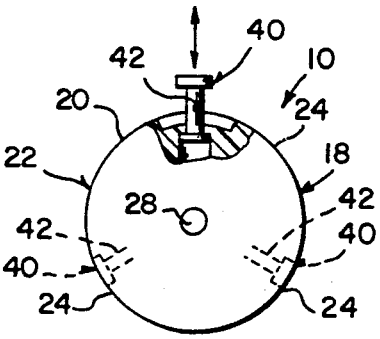
FIG. 4 is a diagrammatic side view with parts broken away of one indicator drum showing another type of register member for a simulated kinged playing piece.

As shown in FIG. 4 a plurality of different register members 40 can be utilized, with each being a pin 42 which can ride up and down within one of the indicia bearing faces 24 in the circumference of the drum 22. When one pin 42 is pulled up it will show the indicator drum 22 as a simulated kinged playing piece when the apparatus 10 is being used for playing checkers.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A board game apparatus comprising:

a) a playing board housing having a top surface with a plurality of different playing field zones disposed therein; and b) a plurality of changeable playing indicating pieces, each built into said playing board housing within each of playing field zones so that one portion of each said playing indicating piece will always extend above the top surface of said playing board housing to be utilized during the play of the game. wherein each said playing indicating piece includes:

a hollow indicator drum having a plurality of indicia bearing faces extending about its circumference and a plurality of depressions extending about its interior surface with each depression being opposite from each indicia bearing face;

a shaft for rotatably supporting said indicator drum with said playing board housing at the playing field zone on the top surface thereof;

a ferromagnetic ball to ride within the interior surface of said indicator drum; and a permanent magnet carried in said playing board housing below said indicator drum to attract said ferromagnetic ball thereto and stop said interior drum from rotating.

2. A board game apparatus as recited in claim 1, wherein each said indicator drum further includes a plurality of cam systems, each located within each depression to help lift said ball so that said indicator drum can be easily manually rotated in either direction to change the indicia on the exposed circumference about the top surface of said playing board housing.

3. A board game apparatus as recited in claim 2, wherein each said indicator drum further includes a register member pivotly mounted on the top surface of said playing board housing at the playing field zone so that said register member can be raised over siad indicator drum to show it as a simulated kinged playing piece when said apparatus is being used for playing checkers.

4. A board game apparatus as recited in claim 2, wherein each said indicator drum further includes a plurality of register members, each being a pin which can ride up and down within one of the indicia bearing faces in the circumference of said drum so when one pin is pulled up it will show said indicator drum as a simulated kinged playing piece when said apparatus is being used for playing checkers.

* * * * *